US007753256B2

(12) United States Patent
Sultana

(10) Patent No.: US 7,753,256 B2
(45) **Date of Patent: *Jul. 13, 2010**

(54) DESKTOP CHANGE HOLDER AND WALL MOUNT

(75) Inventor: David V. Sultana, Park Ridge, IL (US)

(73) Assignee: Bankabank, LLC, Park Ridge, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/942,804

(22) Filed: Nov. 20, 2007

(65) Prior Publication Data

US 2008/0067226 A1 Mar. 20, 2008

Related U.S. Application Data

(63) Continuation of application No. 11/348,164, filed on Feb. 6, 2006, now Pat. No. 7,316,345.

(60) Provisional application No. 60/651,057, filed on Feb. 8, 2005.

(51) Int. Cl.
*A47G 29/00* (2006.01)

(52) U.S. Cl. ..... 232/4 R; 232/1 D; 206/815; 446/8; 109/50

(58) Field of Classification Search ..... 232/4 R, 232/1 D; D99/34; 206/0.815; 446/8; 150/150; 220/481, 476, 628; 109/50; 108/25, 26; 211/90.01, 90.02, 88.01; 248/235
See application file for complete search history.

(56) References Cited

U.S. PATENT DOCUMENTS 166,978 A * 8/1875 Feigl ..... 446/8
569,675 A 10/1896 Seiler
D044,657 S 9/1913 Brunhoff
1,242,820 A * 10/1917 Levay et al. ..... 232/4 R
1,271,416 A * 7/1918 Baker ..... 232/4 R
1,395,008 A * 10/1921 Prince ..... 232/6
1,552,510 A * 9/1925 Scofield ..... 211/88.01
1,570,572 A * 1/1926 Lowenstein ..... 232/4 R
2,196,356 A 4/1940 DeSipio et al.
2,225,623 A 12/1940 Crawford
2,427,763 A 9/1947 Carper
2,779,128 A * 1/1957 West ..... 446/8
D183,094 S 6/1958 Heath et al.
3,160,283 A * 12/1964 Lachance ..... 211/184
3,361,142 A 1/1968 Shelton et al.
4,047,615 A * 9/1977 Browne ..... 211/88.01
4,088,250 A 5/1978 Schaefer
4,403,700 A * 9/1983 Manlove ..... 211/88.01
4,450,975 A 5/1984 Glass et al.
4,454,204 A * 6/1984 Posey ..... 428/542.4

(Continued)

OTHER PUBLICATIONS

Office Action, mail date Mar. 1, 2007, 9 pages.

*Primary Examiner*—William L. Miller
(74) *Attorney, Agent, or Firm*—Brooks Kushman P.C.

(57) ABSTRACT

A bank assembly comprising a bank storage unit, a bank holder and a closed bottom portion is provided. The bank storage unit defines a cavity therein for storing money. The bank holder is capable of being mounted to a vertical surface. The closed bottom portion is coupled to the bank holder and extends away from the bank holder. The closed bottom portion and the bank holder coact with each other to support the bank storage unit.

17 Claims, 6 Drawing Sheets

U.S. PATENT DOCUMENTS 4,613,049 A * 9/1986 Walker ..... 211/90.01
4,730,738 A * 3/1988 Bartus et al. ..... 211/90.02
5,170,907 A * 12/1992 Sakai ..... 220/481
5,870,969 A 2/1999 Boyce
D409,352 S 5/1999 Nolte et al.
6,039,213 A * 3/2000 Sloan et al. ..... 222/39
D423,267 S 4/2000 Roth et al.
6,186,852 B1 * 2/2001 Davis ..... 446/8
6,547,109 B1 4/2003 Kim
D493,939 S 8/2004 Baumhogger et al.
D504,549 S 4/2005 Sultana
7,318,522 B2 * 1/2008 Adam ..... 206/63.5
2006/0185988 A1 8/2006 Sultana

* cited by examiner

DESKTOP CHANGE HOLDER AND WALL MOUNT

CROSS-REFERENCE TO RELATED APPLICATIONS

This application is a continuation of U.S. application Ser. No. 11/348,164 filed Feb. 6, 2006, now U.S. Pat. No. 7,316,345 which, in turn, claims the benefit of U.S. provisional application Ser. No. 60/651,057 filed Feb. 8, 2005, which is hereby incorporated by reference.

BACKGROUND

1. Technical Field

The embodiments described herein generally relate to banks for storing coins or other like items.

2. Background Art

Bank storage units have been known for some time. Bank storage units are commonly known as piggy banks or coin holders and are used primarily by children. At times, bank storage units have been used by adults for storing loose change. These piggy banks are used as a means for teaching children money saving skills in addition to providing a hassle free mechanism for storing loose change for adults. Although piggy banks have proved worthy in terms of their utility, piggy banks have long been considered as items normally intended for use by children. A need exists for a bank storage unit that caters to the needs and lifestyles of both children and adults alike. It would be desirable to provide a bank storage unit that is easily adapted to be positioned or rest on any flat surface, in addition to, for security or convenience purposes, a bank storage unit that may be mounted to any wall or door for stowing or concealing the bank storage unit.

SUMMARY

In one embodiment, a bank assembly is provided. The bank assembly comprises a bank storage unit, a bank holder and a closed bottom portion. The bank storage unit defines a cavity therein for storing money. The bank holder is capable of being mounted to a vertical surface. The closed bottom portion is coupled to the bank holder and extends away from the bank holder. The closed bottom portion and the bank holder coact with each other to support the bank storage unit.

In another embodiment, a bank storage holder for supporting a bank storage unit is provided. The bank storage holder comprises a bank holder, a bottom portion and an inner wall. The bank holder is coupled to a vertical surface. The bottom portion is coupled to the bank holder and extends away from the bank holder. The inner wall is coupled to the bottom portion and spaced away from the bank holder. The inner wall, the bottom portion, and a portion of the bank holder are adapted to define an opening for receiving a bank storage unit that stores money therein and to support the bank storage unit about the vertical surface.

In another embodiment, a bank assembly comprising a bank storage unit and an access tab is provided. The bank storage unit is capable of being mounted onto a horizontal surface and includes a first opening configured to receive money from a first direction. The access tab is removably coupled to the bank storage unit and includes a second opening configured to receive money from a second direction. The first direction is different from the second direction.

BRIEF DESCRIPTION OF THE DRAWINGS

Other advantages of the present invention will be readily appreciated as the present invention becomes better understood by reference to the following detailed description when considered in connection with the accompanying drawings wherein.

DETAILED DESCRIPTION OF THE PREFERRED EMBODIMENT(S)

Figure 1:
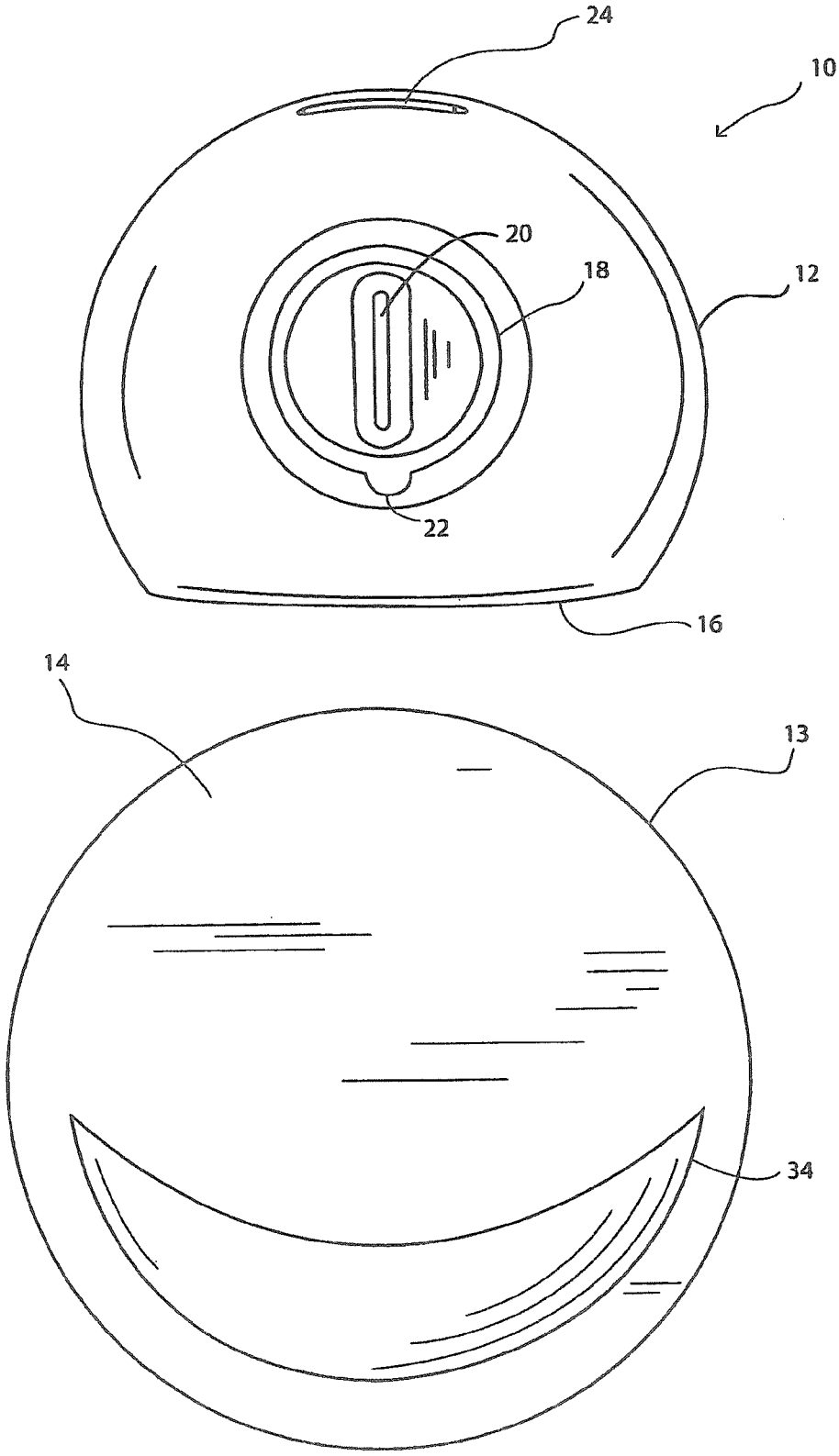
FIG. 1 is an exploded view of a bank assembly.

Referring to FIG. 1, a bank assembly is generally shown at 10 and comprises a bank storage unit 12 and a bank storage holder 13. The bank storage unit 12 is generally shaped in the form of a semi circle. The bank storage unit 12 may be adapted to any number of shapes and sizes. The particular implementation of the bank storage unit 12 may be varied based on a particular implementation. A flat surface portion 16 is disposed at one end of the bank storage unit 12. When the bank storage unit 12 is positioned on any fiat surface, the flat surface portion 16 abuts the flat surface (or horizontal surface). The bank storage unit 12 defines a cavity formed therein for storing a plurality of coins or any like item.

An access tab 18 is removably coupled to the bank storage unit 12. The access tab 18 may be removed to allow the user to empty the contents of the bank storage unit 12 with relative ease. A first slot 20 may be formed within the access tab 18 to allow a user to insert coins in a horizontal direction with the bank storage unit 12. The access tab 18 may be made of soft rubber or plastic (or any flexible material) to facilitate removal and insertion. A tab 22 is integrally formed with the access tab 18 to allow the user to grasp the access tab 18 during the removal and insertion operation. A second slot 24 may be formed on the bank storage unit 12 to allow the user to insert change in a downward vertical direction. The second slot 24 provides the user with an alternate location to insert coins.

The bank storage holder 13 generally comprises a bank holder 14 and a hoister 34. The holster 34 is integrally formed with the bank holder 14. The bank storage holder 13 slideably receives and supports the bank storage unit 12.

Figure 2:
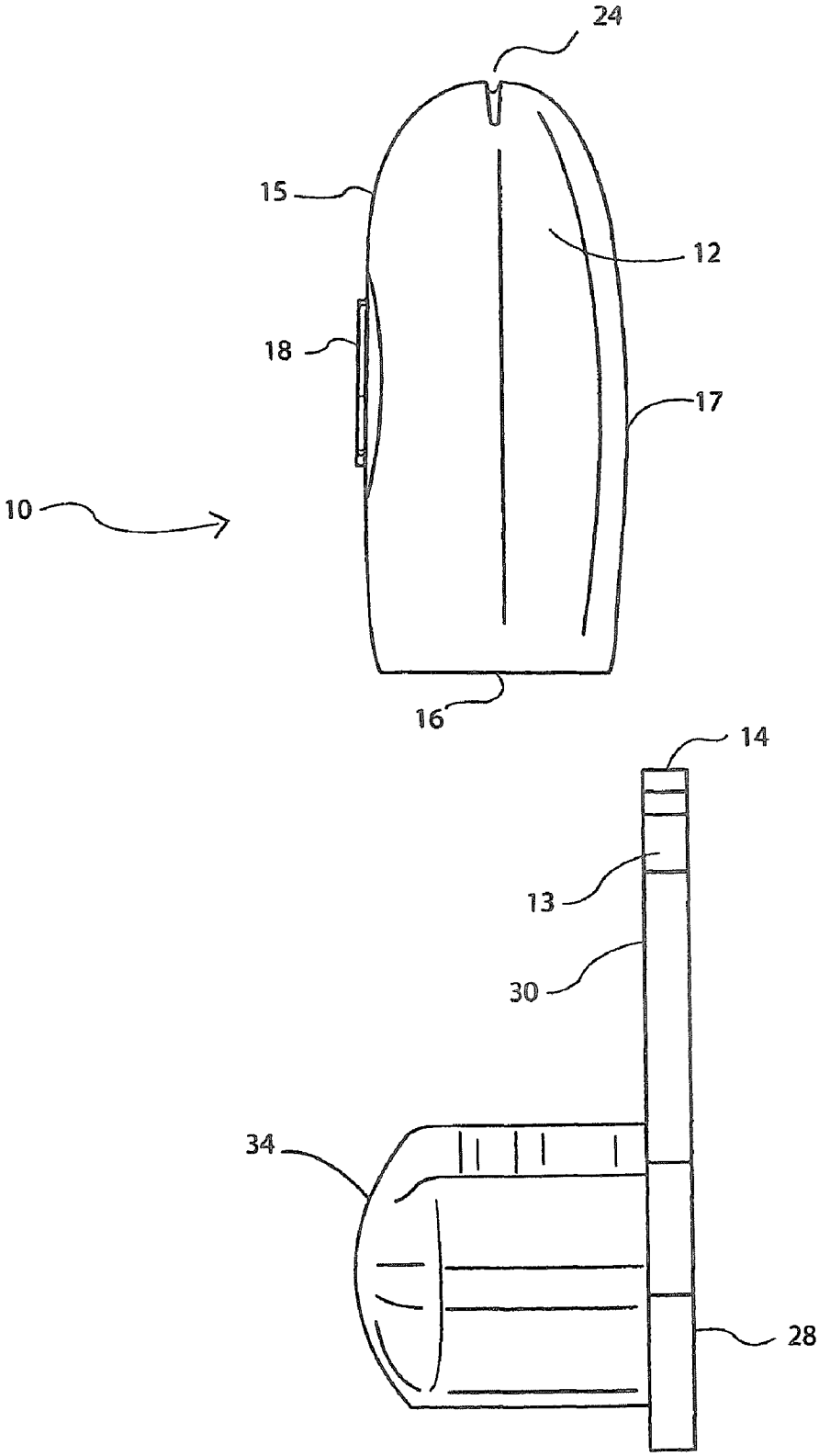
FIG. 2 is a side exploded view of the bank assembly.

Referring to FIG. 2, a side view of the bank storage unit 12 and the bank storage holder 13 is shown. The bank storage unit 12 comprises a first side 15 and a second side 17. The access tab 18 is disposed on the first side 15. FIG. 2 illustrates that the first side 15 generally faces the user. The bank storage holder 13 comprises a first side 28 and a second side 30. When the bank storage holder 13 is coupled to a vertical surface (e.g., a wall or door), the first side 28 of the bank storage holder 13 positioned adjacent the vertical surface.

Figure 3:
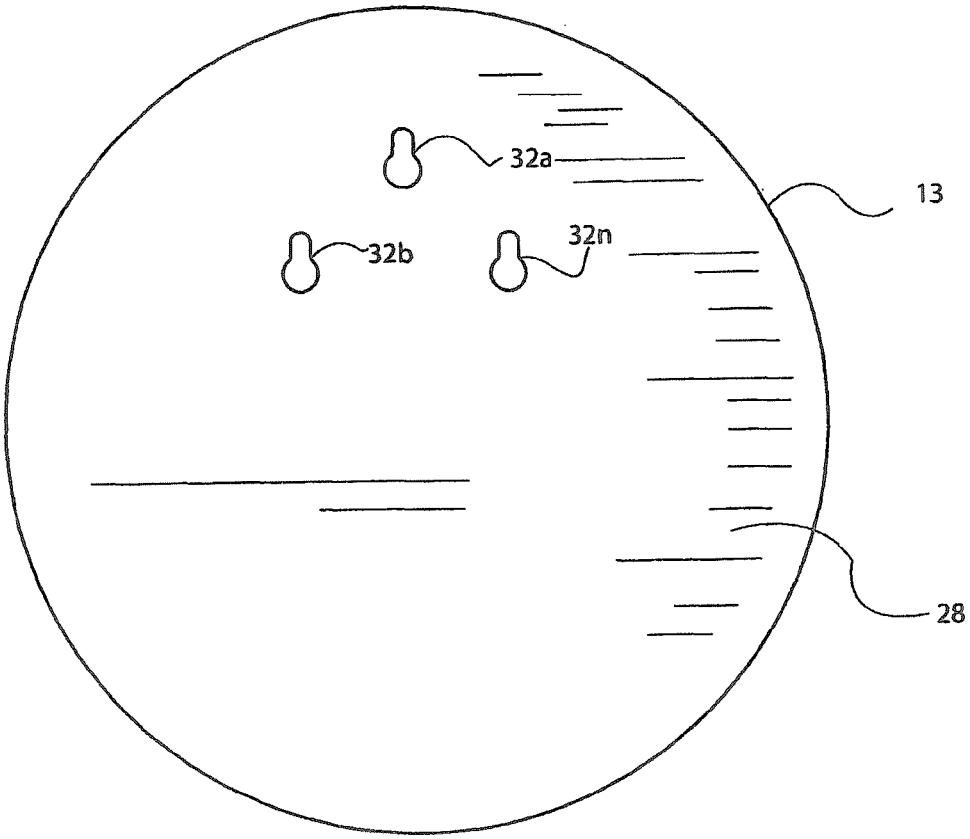
FIG. 3 is a rear view of the bank storage holder.

Referring to FIG. 3, a back view of the bank storage holder 13 is shown. The bank storage holder 13 comprises a plurality of mounting holes 32*a*-32*n*. The mounting holes 32*a*-32*n* allow the bank storage holder 13 to be coupled to the vertical surface. The mounting holes 32*a*-32*n* may receive the head of a nail or screw to couple the bank storage holder 13 to the vertical surface. The bank storage unit 12, the bank holder 14, the holster 34 and the support strips 40*a*-40*n* may be constructed from plastic, stainless steel, silicon, pewter, wood and/or ceramic.

Figure 4:
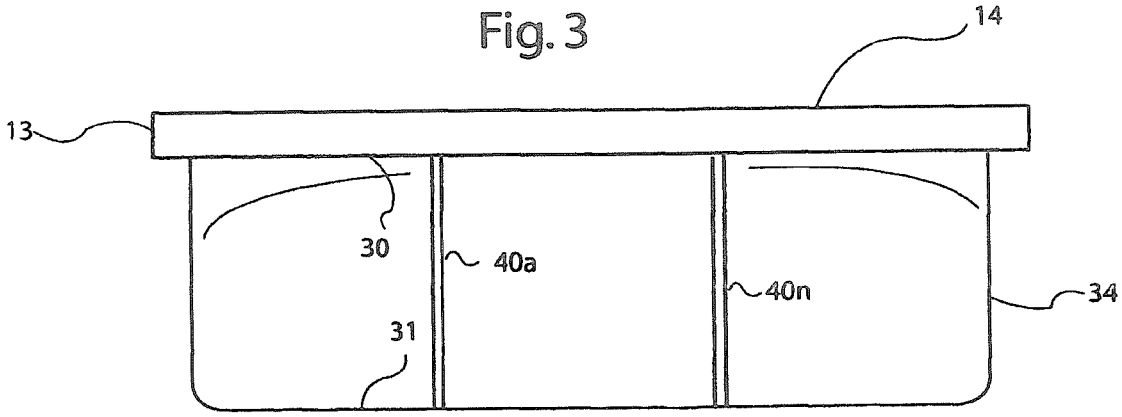
FIG. 4 is a top view of a bank holder, a holster, and one or more support strips in accordance with the present invention.

Referring to FIG. 4, a top view of the holster 34 is shown. The holster 34 comprises one or more support strips 40*a*-40*n*. The support strips 40*a*-40*n* are axially spaced and parallel to one another. Each support strip 40*a*-40*n* may be configured to have a similar height relative to each other. However, other embodiments may include support strips 40*a*-40*n* that have different heights from each other. The height of the support strips may 40*a*-40*n* may be varied to meet a particular implementation. The holster 34 includes an inner wall 31. The support strips 40*a*-40*n* extend between the second side 30 of the bank holder 14 and the inner wall 31 of the holster 34.

Figure 5:
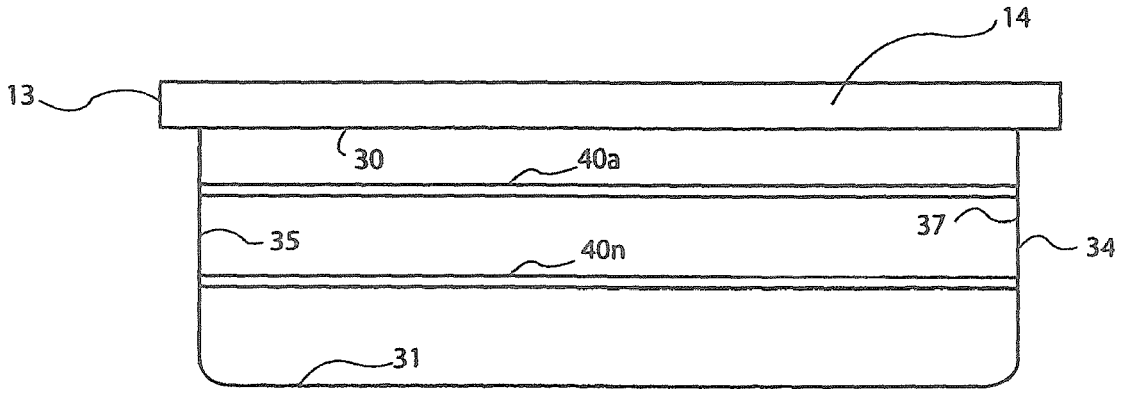
FIG. 5 is a top view of the holster and the support strips in accordance with another embodiment.

Referring to FIG. 5, a top view of another embodiment of the holster 34 is shown. The holster 34 comprises a first portion 35 and a second portion 37. The support strips 40*a*-40*n* extend between the first portion 35 and the second portion 37. In reference to the implementation of the support strips 40*a*-40*n* as shown in FIGS. 4-5, it may be possible to implement a single support strip to support the bank storage unit 12. With such an implementation, the support strip may be centered within the holster 34 and extend between the first side 30 of the bank holder 14 and the inner wall 31 of the holster 34 to sufficiently support the bank storage unit 12. The support strips 40*a*-40*n* may be implemented in a number of arrangements. The support strips 40*a*-40*n* may be arranged in a crossing pattern with each other. The arrangement of the support strips 40*a*-40*n* may be varied to meet the design criteria of a particular implementation.

Figure 6:
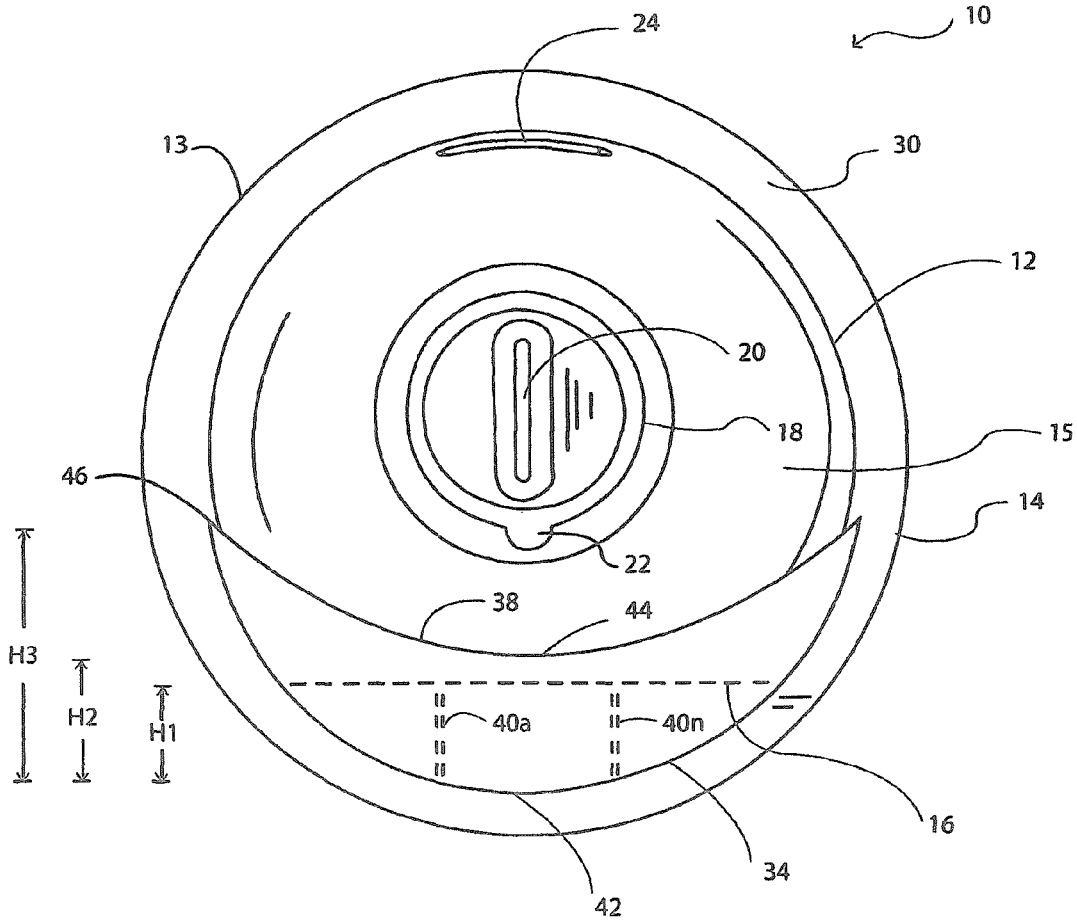
FIG. 6 is a view of the bank storage unit positioned on bank storage holder in accordance with the present invention.

Referring to FIG. 6, a front view of the bank storage unit 12 positioned on bank storage holder 13 is shown. The holster 34 slideably receives and supports the bank storage unit 12. The flat surface portion 16 of the bank storage unit 12 abuts the support strips 40*a*-40*n*. A portion of the first side 15 of the bank storage unit 12 abuts an inner wall 31 of the holster 34. The second side 17 (not shown) of the bank storage unit 12 abuts the second side 30 of the bank holder 14. The bank holder 14 in combination with the holster 34 is generally configured to securely support the bank storage unit 12. The holster 34 includes a first edge 38 (or top edge of the holster in reference to the orientation of the bank assembly as shown in FIG. 6). The first edge 38 may be curved in a downward orientation to form a circumferential lip across the holster 34. In one example, the first edge 38 may be implemented as a straight line from one end of the holster 34 to another end of the holster 34. The support strips 40*a*-40*n* may be defined by a first height H1. The first height H1 is the length of between the bottom of the support strips 40*a*-40*n* and the top of the support strips 40*a*-40*n*. The first edge 38 may be defined by a second height H2 and a third height H3. The second height H2 is the length between a bottom portion 42 of the holster 34 and a center 44 of the first edge 38. The third height H3 is the length between the bottom portion 42 of the holster 34 an upper portion 46 of the holster 34. To sufficiently secure the bank storage unit 12 to the bank storage holder 13, the first height H1 of the support strips 40*a*-40*n* should be less than the second height H2 of the first edge 38. Such a configuration will ensure that the bank storage unit 12 will not fall forward or off of the bank storage holder 13 if the vertical surface (on which the bank assembly may be coupled to) is not exactly 90 degrees. The height H1, H2 and H3 may be varied to meet the design criteria of a particular implementation.

Figure 7:
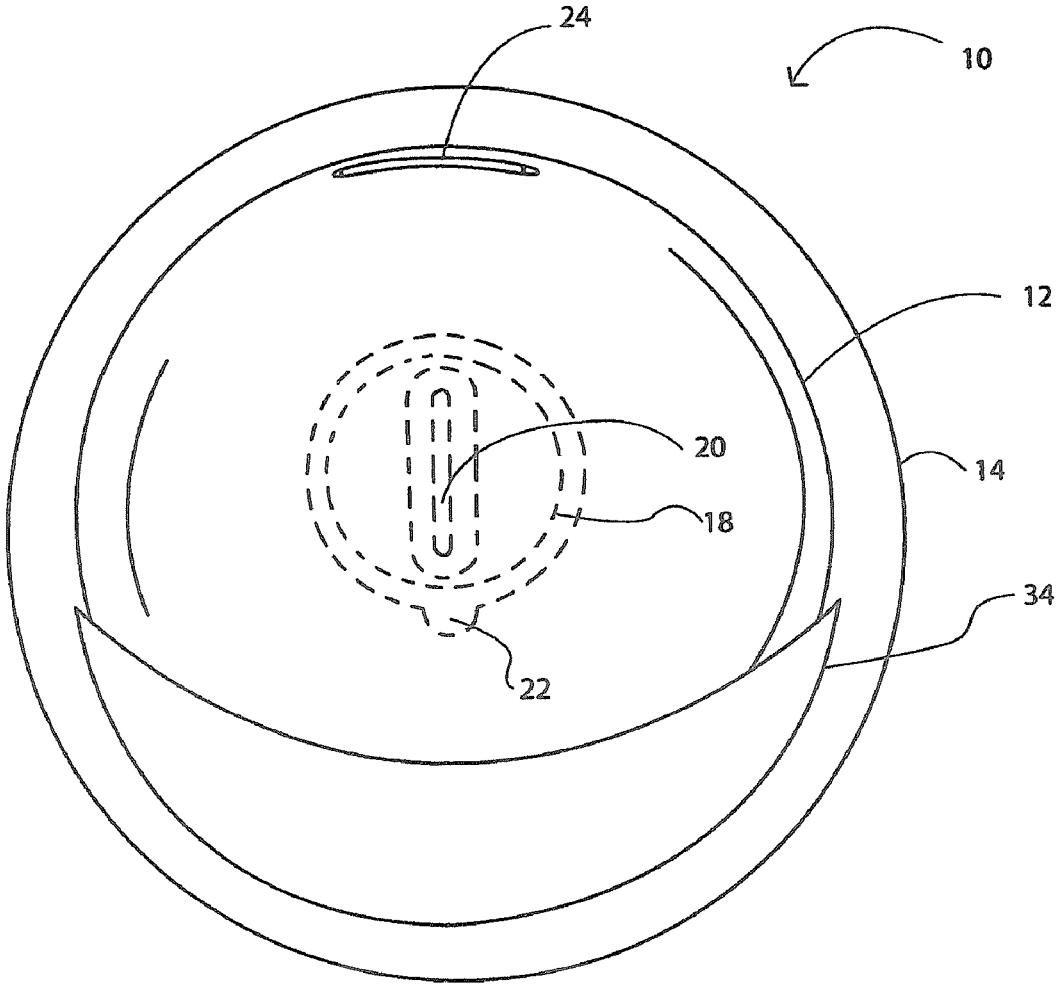
FIG. 7 is a view of the bank storage unit positioned on bank storage holder in accordance with another embodiment.

Referring to FIG. 7, a front view of the bank assembly 10 illustrates the bank storage unit positioned on the bank holder one hundred and eighty degrees from the position of the bank storage unit as shown in FIG. 6. The holster 34 and the bank holder 14 may be configured to support the bank storage unit 12 when the second side 17 of the bank storage unit 12 is positioned to face away from the vertical surface and toward the user. Such a configuration may allow a manufacturer to decorate the surface area of the second side 17 of the bank storage unit 12. Adult and children themes may be used to decorate the bank assembly to attract consumers.

While not illustrated, the bank assembly may be implemented without support strips 40*a*-40*n*. In one example, the holster may be formed in the shape of a rectangle having a cavity therebetween for supportably receiving the bank storage unit 12. Such a holster may supportably receive a bank storage unit 12 shaped in the form of a semi-circle or in the form of a rectangle. The shape of the bank storage unit 12 and the holster 34 may be implemented to form a number of interlocking shapes and/or forms to allow the bank storage holder 13 to adequately support the bank storage unit 12.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that the invention may be practiced otherwise than as specifically described.

What is claimed is:

1. A bank assembly comprising:

a bank storage unit defining a cavity therein for storing money;

a bank holder for being mounted to a vertical surface;

a bottom portion being integrally formed to the bank holder and extending away from the bank holder for contacting the bank storage unit, wherein the bottom portion and at least a portion of the bank holder coact with each other to support the bank storage unit;

an inner wall coupled to the bottom portion and being spaced away from the bank holder, wherein the inner wall extends above the bottom portion and wherein the inner wall, the bottom portion, and the bank holder define an opening for receiving the bank storage unit; and a first portion and a second portion that are spaced apart from one another and integrally formed to the bank holder and to the bottom portion, wherein the first portion and the second portion each (i) extend away from the bank holder, (ii) extend above the bottom portion, and (iii) join the inner wall.

2. The bank assembly of claim 1 wherein the bank storage unit includes a first side, a second side and a flat surface portion, wherein the flat surface portion is adapted to rest on a horizontal surface for supporting the bank storage unit on the horizontal surface.

3. The bank assembly of claim 2 wherein the bank storage unit further includes an access tab disposed on at least one of the first side, the second side and the flat surface portion.

4. The bank assembly of claim 3 wherein the access tab is removably coupled to at least one of the first side, the second side and the flat surface portion.

5. The bank assembly of claim 3 wherein the access tab includes a first opening for receiving money in a first direction.

6. The bank assembly of claim 5 wherein the bank storage unit further includes a second opening for receiving money in a second direction that is different from the first direction.

7. The bank assembly of claim 1 wherein the first portion, the second portion, the bottom portion and the inner wall form a holster and wherein the holster and the bank holder defines the opening for receiving the bank storage unit.

8. The bank assembly of claim 7 wherein the bank storage unit defines a front face positioned opposite to the bank holder, and wherein the bottom portion is positioned at a first height within the holster such that a substantial portion of the front face extends above the holster.

9. The bank assembly of claim 1 wherein the bank holder and the bottom portion are each formed from a first material and are integrally formed together via the first material.

10. A bank assembly comprising:

a bank storage unit defining a cavity therein for storing money;

a bank holder for being mounted to a vertical surface; and a holster integrally formed to the bank holder to provide a unitary piece, the holster comprising:

a bottom portion extending away from the bank holder;

a wall generally spaced apart from the bank holder and extending above the bottom portion;

a first portion; and a second portion that is spaced apart from the first portion, wherein the first portion and the second portion each (i) extend away from the bank holder, (ii) extend above the bottom portion, and (iii) join the wall, wherein the holster receives the bank storage unit and wherein the bank holder and the holster co-act with one another to support the bank storage unit about the vertical surface.

11. The bank assembly of claim 10 wherein the bank storage unit includes a bottom portion and the holster extends below and above the bottom portion, and wherein the bank holder and the holster surround the bottom portion of the bank storage unit.

12. The bank assembly of claim 10 wherein the bank holder and the holster are each formed via a first material and are integrally formed together via the first material.

13. The bank assembly of claim 10 wherein the bank storage unit defines a front face positioned opposite to the bank holder and the bottom portion is positioned at a first height within the holster such that a substantial portion of the front face extends above the holster.

14. A bank assembly comprising:

a bank storage unit defining a cavity therein for storing money;

a bank holder for being mounted to a vertical surface; and a holster coupled to the bank holder, wherein the holster receives the bank storage unit, wherein the bank storage unit includes a bottom portion, wherein the holster extends from below the bottom portion of the bank storage unit to a position above the bottom portion of the bank storage unit, wherein the bank holder and the holster surround the bottom portion of the bank storage unit for supporting the bank storage unit about the vertical surface, and the holster comprising:

a first bottom portion extending away from the bank holder;

a wall generally spaced apart from the bank holder and extending above the first bottom portion;

a first portion; and a second portion spaced apart from the first portion, wherein the first portion and the second portion each (i) extend away from the bank holder, (ii) extend above the first bottom portion, and (iii) join the wall.

15. The bank assembly of claim 14 wherein the holster is integrally formed to the bank holder.

16. The bank assembly of claim 15 wherein the bank holder and the holster are each formed via a first material and are integrally formed together via the first material.

17. The bank assembly of claim 14 wherein the bank storage unit defines a front face positioned opposite to the bank holder, and wherein the first bottom portion receives the bank storage unit and is positioned at a first height within the holster such that a substantial portion of the front face extends above the wall.

* * * * *